United States Patent [19]

Spekman, Jr.

[11] 4,390,465

[45] Jun. 28, 1983

[54] LOW TEMPERATURE COMPOSITION FOR PLATING PRETREATMENT OF FERROUS METALS

[75] Inventor: Paul Spekman, Jr., Bloomington, Minn.

[73] Assignee: Fremont Industries, Inc., Shakopee, Minn.

[21] Appl. No.: 275,800

[22] Filed: Jun. 22, 1981

[51] Int. Cl.[3] ..... C11D 1/825; C23G 1/14

[52] U.S. Cl. ..... 252/527; 134/40; 252/135; 252/156; 252/158; 252/174.16; 252/530; 252/DIG. 14; 252/DIG. 17

[58] Field of Search ..... 134/40; 252/156, 158, 252/174.16, 135, 527, 530, DIG. 17, 554

[56] References Cited

U.S. PATENT DOCUMENTS

| | | | |
|---|---|---|---|
| 2,990,374 | 6/1961 | Schwartz | 252/136 |
| 3,039,970 | 6/1962 | Krueger et al. | 252/135 |
| 3,312,624 | 4/1967 | Dupre et al. | 252/135 |
| 3,650,831 | 3/1972 | Jungermann et al. | 134/27 |
| 4,048,121 | 9/1977 | Chang | 252/527 |

FOREIGN PATENT DOCUMENTS 1445716 8/1976 United Kingdom .

248887 3/1968 U.S.S.R. .

OTHER PUBLICATIONS

Krupin, "Phosphate Ester Surfactants-Newer Uses", Soap & Chemical Specialties, May 1969, pp. 86, 87.

*Primary Examiner*—P. E. Willis, Jr.

*Attorney, Agent, or Firm*—Orrin M. Haugen; Thomas J. Nikolai

[57] ABSTRACT

A preparation of an aqueous pre-treatment working solution for ferrous metals, wherein the composition includes in its formulation a composite alkaline builder including sodium hydroxide, sodium metasilicate, and sodium carbonate, water conditioners including sodium tripolyphosphate and tetrasodium ethylenediaminetetraacetate, a brightener consisting of alpha-sodium glucoheptonate dihydrate, a surfactant including a mixture of the sodium salt of petroleum sulfonic acid and linear ethoxylated alcohol organic phosphate ester complex, and a modified straight chain aliphatic polyether, and an emulsion coupling agent consisting of hexylene glycol. The formulation may be utilized at a temperature which is only very slightly or modestly elevated above ambient, and may be cooled so as to demulsify the soil retaining oils prior to disposal.

3 Claims, No Drawings

LOW TEMPERATURE COMPOSITION FOR PLATING PRETREATMENT OF FERROUS METALS

BACKGROUND OF THE INVENTION

The present invention relates generally to a formulation for the pretreatment of ferrous metals which are destined for plating operations, and more particularly to an improved composition for the preparation of aqueous pretreatment working solutions for ferrous metals.

Ferrous metals are frequently coated with protective and/or decorative metals. In order to prepare the surfaces of the ferrous metals for the plating or finishing operation, the surfaces must be treated so as to remove any residual oils which tend to attract and retain soil, and thereby rendering the metal surfaces receptive to plating. Residual soil, normally in the form of a soil retaining oil adversely affect the capability of the surface to receive a uniform and tightly adherent coating.

Examples of such metal coatings in wide usage today include zinc, chromium, and nickel, as well as others, each having its own specific function and purpose. Surface plating is performed on ferrous metals in order to provide protection from the environment, improved appearance, or improved electrical conductivity. Plating is ordinarily employed where the construction of the part if made totally of the metal plating, would be economically unjustified or economically unsound.

The final operation for the parts is normally the plating operation. Parts selected for plating normally require pretreatment for the purpose of cleaning the surface and rendering it receptive to the plating materials to be used. Frequently, electrodeposition is employed, although modified forms of deposition may be employed including electroless or the like. When the surfaces of the individual component parts are free of soils and foreign matter, they accept and adherently retain the metallic ions to be plated thereupon.

As examples of foreign materials which are frequently found on the surfaces of manufactured piece parts, the most common is soil retaining oil. Oils are normally used in the various manufacturing operations including stamping, grinding, polishing, buffing, handling and shipping. Each of these operations are responsible for providing surfaces of interfering soil. Examples of such oils are quenching oils, rustproofing oils, drawing oils, stamping and die lubricants, flushing oils, residues of various fats and waxes, as well as abrasives. These soils vary in their individual properties, and frequently are complex, leading to certain difficulties when attempts are made to provide a universal cleaner. The metal finishing of parts incorporating an electrodeposited finish has progressed significantly through the years, with continuing improvements bringing the process capability to the present form of preprogrammed automatic plating lines. Because of the multitude of products being employed, the large volumes of such products and the necessary economics, care must be taken to provide a surface which is both receptive and capable of adhering the metal finishing coat.

Among the operations employed in a plating line, either an automatic rack or a barrel plating system is employed. The configuration including the size and shape of the particular part will ordinarily determine the process to be utilized, and such preselection processes are well known. Parts which are large and complex are normally not effectively plated in a barrel system, but are alternatively fixtured to a rack. Alternatively, when the parts consist of smaller items including screws, nuts, electrical connectors and the like, they may be placed in bulk in a barrel which is rotated in the various stages of the plating cycle. The barrel is provided with holes or bores to enhance circulation of the plating solution, while being sufficiently small so as to prevent parts from inadvertant removal from the barrel.

After the parts have been disposed within the appropriate plating system, they are moved through the plating cycle and ultimately unloaded. The resident time for the parts in each treating operation or station is determined upon the severity of the soil to be removed from the surface, and also the final thickness and finish appearance required in the finished part. Treatment cycles for rack plating are similar to those required for barrel systems, with appropriate compensation being made for the overall surface to be treated.

SUMMARY OF THE INVENTION

In accordance with the present invention, a composition is provided for the preparation of aqueous pretreatment working solutions for ferrous metals, and specifically for the removal of oil retaining soils from the surface of ferrous metal parts. The solution includes a composite alkaline builder along with other components, with the working solution being capable of removing the soil retaining oil from the surface of the parts, and retaining the oil in an emulsified form. Such emulsification occurs and is stable at temperatures which are only very slightly or modestly elevated above ambient. The working solution demulsifies upon cooling to normal room temperature, and the soil retaining oils may be skimmed or otherwise separated from the formulation prior to disposal.

The formulation of the present invention has been found to minimize rejects due to lack of adhesion or cohesion in the plating surface, as well as non-uniform deposition of the finish, or poor appearance of the finished part. As can be appreciated, rejects at this stage of a manufacturing process are costly, and if the rejects are to be salvaged, they require stripping of the plating, reracking, recleaning, and replating.

The composition for the preparation of aqueous working solutions have the formulation as follows:

| Composition | Percent by Weight |
|---|---|
| An alkaline builder including, in the composite, sodium hydroxide, sodium metasilicate, and sodium carbonate wherein the components are present as follows: | |
| Sodium hydroxide | 15-30% |
| Sodium metasilicate | 10-30% |
| Sodium carbonate | 10-30% |
| A water conditioner including, in the composite, sodium tripolyphosphate and tetrasodium ethylenediaminetetraacetate in the concentrations: | |
| Sodium tripolyphosphate (determined as anhydrous) | 10-15% |
| Tetrasodium ethylenediaminetetraacetate (determined as the tetrahydrate) | 1-5% |
| Alpha-sodium glucoheptonate (determined as the dihydrate) | 5-15% |
| Surfactant, including, in the composite, the sodium salt of petroleum sulfonic acid (petroleum sulfonate) | 1-10% |
| Linear ethoxylated alcohol organic phosphate ester complex | 1-10% |

-continued

| Composition | Percent by Weight |
|---|---|
| $RO(CH_2CH_2O)_n$<br>$RO(CH_2CH_2O)_n—P=O$<br>$RO(CH_2CH_2O)_n$ | |
| Wherein R represents an alkyl group containing from between 8 and 10 carbon atoms and wherein "n" is an integer ranging from 1 to 6. | |
| And a modified straight chain aliphatic polyether having the structural formula as follows: | 1-10% |
| $R—O(CH_2CH_2O)_nCH_2CH_2R^1$ | |
| R—alkyl | |
| $R^1$—a hydrophobic group | |
| Wherein R represents an alkyl group, and wherein $R^1$ represents a hydrophobe | |
| Hexylene glycol | 1-10% |

It has been found that working solutions containing from about 1.50% and 9% of the composition represented herein, balance water, are highly effective for the pretreatment of ferrous metal parts.

DESCRIPTION OF THE PREFERRED EMBODIMENT

In accordance with the preferred embodiment of the present invention, a composition for the preparation of aqueous working solutions for the pretreatment of ferrous metals is prepared as follows:

EXAMPLE I

| | Composition | Percent by Weight |
|---|---|---|
| (A) | An alkaline builder including, in the composite, sodium hydroxide, sodium metasilicate, and sodium carbonate wherein the components are present as follows: | |
| | Sodium hydroxide | 25.0 |
| | Sodium metasilicate | 10.0 |
| | Sodium carbonate | 30.0 |
| (B) | A water conditioner including, in the composite, sodium tripolyphosphate and tetrasodium ethylenediaminetetraacetate in the concentrations: | |
| | Sodium tripolyphosphate (determined as anyhydrous) | 15.0 |
| | Tetrasodium ethylene-diaminetetraacetate (determined as the tetrahydrate) | 1.0 |
| | Alpha-sodium glucoheptonate (determined as the dihydrate) | 5.0 |
| (C) | A surfactant, including, in the composite, the sodium salt of petroleum sulfonic acid (petroleum sulfonate) | 5.0 |
| | Linear ethoxylated alcohol organic phosphate ester complex | 1.7 |
| | $RO(CH_2CH_2O)_n$<br>$RO(CH_2CH_2O)_n—P=O$<br>$RO(CH_2CH_2O)_n$ | |
| | Wherein R represents an alkyl group containing from between 8 and 10 carbon atoms and wherein "n" is an integer ranging from 1 to 6. | |
| | And a modified straight chain aliphatic polyether having the structural formula as follows: | 1.7 |
| | $R—O(CH_2CH_2O)_nCH_2CH_2R^1$ | |
| | R—alkyl | |
| | $R^1$—a hydrophobic group | |
| | Wherein R represents an alkyl group, and wherein $R^1$ represents a hydrophobe | |
| (D) | Hexylene glycol | 5.6 |

EXAMPLE II

| | Composition | Percent by Weight |
|---|---|---|
| (A) | An alkaline builder including, in the composite, sodium hydroxide, sodium metasilicate, and sodium carbonate wherein the components are present as follows: | |
| | Sodium hydroxide | 20.0 |
| | Sodium metasilicate | 15.0 |
| | Sodium carbonate | 27.8 |
| (B) | A water conditioner including, in the composite, sodium tripolyphosphate and tetrasodium ethylenediaminetetraacetate in the concentrations: | |
| | Sodium tripolyphosphate (determined as anhydrous) | 15.0 |
| | Tetrasodium ethylene-diaminetetraacetate (determined as the tetrahydrate) | 0.5 |
| | Alpha-sodium glucoheptonate (determined as the dihydrate) | 10.5 |
| (C) | A surfactant, including, in the composite, the sodium salt of petroleum sulfonic acid (petroleum sulfonate) | 2.5 |
| | Linear ethoxylated alcohol organic phosphate ester complex | 4.2 |
| | $RO(CH_2CH_2O)_n$<br>$RO(CH_2CH_2O)_n—P=O$<br>$RO(CH_2CH_2O)_n$ | |
| | Wherein R represents an alkyl group containing from between 8 and 10 carbon atoms and wherein "n" is an integer ranging from 1 to 6. | |
| | And a modified straight chain aliphatic polyether having the structural formula as follows: | 1.5 |
| | $R—O(CH_2CH_2O)_nCH_2CH_2R^1$ | |
| | R—alkyl | |
| | $R^1$—a hydrophobic group | |
| | Wherein R represents an alkyl group, and wherein $R^1$ represents a hydrophobe | |
| (D) | Hexylene glycol | 3.0 |

EXAMPLE III

| | Composition | Percent by Weight |
|---|---|---|
| (A) | An alkaline builder including, in the composite, sodium hydroxide, sodium metasilicate, and sodium carbonate wherein the components are present as follows: | |
| | Sodium hydroxide | 30.0 |
| | Sodium metasilicate | 10.0 |
| | Sodium carbonate | 25.0 |
| (B) | A water conditioner including, in the composite, sodium tripolyphosphate and tetrasodium ethylenediaminetetraacetate in the concentrations: | |
| | Sodium tripolyphosphate (determined as anyhydrous) | 10.0 |

-continued

| | Composition | Percent by Weight |
|---|---|---|
| | Tetrasodium ethylenediaminetetraacetate (determined as the tetrahydrate) | 1.0 |
| | Alpha-sodium glucoheptonate (determined as the dihydrate) | 5.0 |
| (C) | A surfactant, including, in the composite, the sodium salt of petroleum sulfonic acid (petroleum sulfonate) | 7.0 |
| | Linear ethoxylated alcohol organic phosphate ester complex | 1.5 |
| | $RO(CH_2CH_2O)_n$<br>$RO(CH_2CH_2O)_n-P=O$<br>$RO(CH_2CH_2O)_n$ | |
| | Wherein R represents an alkyl group containing from between 8 and 10 carbon atoms and wherein "n" is an integer ranging from 1 to 6. | |
| | And a modified straight chain aliphatic polyether having the structural formula as follows: | 4.2 |
| | $R-O(CH_2CH_2O)_nCH_2CH_2R^1$<br>R—alkyl<br>$R^1$—a hydrophobic group<br>Wherein R represents an alkyl group, and wherein $R^1$ represents a hydrophobe | |
| (D) | Hexylene glycol | 6.3 |

This composition is utilized with water to form an aqueous working solution, with the working solution containing 6.0% of the composition.

The alkaline builders provide the high alkalinity, with a pH of the working solution normally ranging between about 12.0 and 14.0, with such pH levels being useful in aiding soil saponification and providing a medium containing an electrolyte to maximize the performance of the surfactant. The component in the builder performing this function is sodium hydroxide.

The builder also includes sodium metasilicate, which is a second high alkalinity source, as well as a soil dispersent, emulsifier, soil suspender, and soil anti-redeposition agent. The alkaline builder also includes sodium carbonate which provides a high pH buffer.

The water conditioner is a combination of sodium tripolyphosphate and tetrasodium ethylenediaminetetraacetate. This component functions as a sequestrant of hard water components, such as calcium and magnesium ions, which normally interfere with the effectiveness of metal cleaning. The tetrasodium ethylenediaminetetraacetate is a metal complexant agent which maintains the metallic ions in a soluble state, and normally prevents the precipitation of the metal ions as the hydroxide, the chloride, or sulfate, thereby aiding in conditioning of the water.

The alpha-sodium glucoheptonate is a metal brightener and desmutter. This is a sugar acid type of metal complexing agent useful in the removal of light oxide films from metallic surfaces, thereby leaving a bright and active substrate for subsequent plating operations. This material also removes light forms of carbonaceous residues which are formed during certain metal treating operations performed at high temperatures, such as is encountered at steel mills.

The surfactant-emulsifier system includes the sodium salt of petroleum sulfonic acid, with this component normally having the following structural formula:

$NaRSO_3$ wherein R is an aliphatic member. The formulation is normally 62% active, containing 34% mineral oil carrier as a fluid diluent. The solution may contain between about 3% and 5% of water. The molecular weight ranges from between about 415 and 430. This agent functions as a fat-splitting component, which acts as a temporary emulsifier, solubilizer, dispersant and flotation component. Upon demulsification, the oily soils are removed. In solution, however, the oily soils act as an anionic radical.

The surfactant also contains a linear ethoxylated alcohol organic phosphate ester complex having the structural formula as follows:

$$\begin{array}{l} RO(CH_2CH_2O)_n \\ RO(CH_2CH_2O)_n-P=O \\ RO(CH_2CH_2O)_n \end{array}$$

Wherein R represents an alkyl group having between 8 and 10 carbon atoms. This component serves an anionic surfactant and hydrotropic solubilizer of other components in the surfactant emulsifier system. The surfactant-emulsifier system also includes a modified straight-chain aliphatic polyether having the structural formula as follows:

$$R-O(CH_2CH_2O)_nCH_2CH_2R^1$$

wherein $R^1$ represents a hydrophobe.

This provides a low foaming non-ionic surfactant which enhances the detergency of the total system and aids in defoaming of saponified soils, and also increases the wetting action of metal substrates.

The emulsion coupling agent is hexylene glycol, which is used as a solubilizing coupling agent and emulsion stabilizer for the oily soil.

TYPICAL USES AND APPLICATIONS

As indicated, the formulation of the present invention may be used in an aqueous solution for treating parts either through a barrel plating operation or a rack plating operation. The sizes and configurations of the components will determine the most appropriate operation, with a barrel system being appropriate for the smaller items such as screw machine parts and the like, and with larger parts or components being utilized on a rack system.

After the individual parts have either been racked or loaded into a barrel, they then will proceed through the various operations in the complete plating cycle. Modern technology provides programmable and computerized systems such that the only manual or labor-intensive operations is the physical loading of the raw parts and in certain instances the unloading of the finished parts. The resident time in each of the operations or stations is determined for the most part by the condition of the individual parts, as well as the specified final thickness of the finish to be applied. In this application, a typical barrel plating cycle is given as an example, it being understood that rack plating cycles would be similar with the only changes being determined by the times and tank capacities due to the nature of the larger sizes of the individual components or parts.

BARREL PLATING OPERATION

| Stage | Stations | Concentration | Temp. | Capacity | Time |
|---|---|---|---|---|---|
| Soak | 2 | 8–10 oz/gal. of formulation of Example I | 130° F. | 520 gal. | 6.23 min. |
| Anodic clean | 2 | 4–6 oz/gal. of formulation of a selected anodic cleaning formulation as commercially available | 200° F. | 606 gal. | 6.23 min. |
| Rinse | 1 | | | | 17 sec. |
| Rinse | 1 | | | | 1.35 min. |
| Acid pickle | 2 | 7 oz/gal.Hcl 20 oz/gal $H_2SO_4$ | 130° F. | 550 gal. | 6.68 min. |
| Rinse | 1 | | | | 37 sec. |
| Rinse | 1 | | | | 17 sec. |
| Electro-clean | 2 | 4–6 oz/gal. | 200° F. | 606 gal. | 3.83 min. |
| Rinse | 1 | | | | 17 sec. |
| Rinse | 1 | | | | 17 sec. |
| Zinc plating | 16 | 1.2–1.5 oz/gal zinc 12–14 oz/gal.NaOH | 85° F. | 4440 gal. | 60 min. |
| Rinse | 1 | | | | 17 sec. |
| Rinse | 1 | | | | 17 sec. |
| Nitric Acid Bright Dip | 1 | 1.5% by volume | | 230 gal. | 17 sec. |
| Rinse | 1 | | | | 1.33 min. |
| Dichro-mate | 1 | | | 230 gal. | 15 sec. |
| Rinse | 1 | | | | 17 sec. |
| Rinse | 1 | | | | 17 sec. |
| Hot Rinse | 1 | | 140° F. | 230 gal. | 17 sec. |
| Unload | | | | | |

TYPICAL SCREW MACHINE PARTS

Since the individual process may be reasonably complex, it is frequently desirable to minimize the generation of rejects which may occur due to a lack of adhesion or cohesion of the plating, a nonuniform deposition or lack of achieving the final finish or appearance specified. Rejected parts are, of course, uneconomical inasmuch as if they are to be salvaged, the plating must be stripped, the individual components reracked or reinserted in a barrel, re-cleaned, and ultimately replated. Such rejects are non-economical inasmuch as they contribute to a loss of overall energy, labor, chemicals, and thus may become cost ineffective.

With respect to the barrel plating operation defined above, the individual parts which are to be plated are cleaned in order to free them of interferring foreign material including oil, soil-retaining oils and the like. The cleaning in this operation occurs in a one or two station soak cleaning tank where the majority of soils are removed along with any adhering carbonaceous material generally defined as "smut". This is ideally followed by a rinse station, with the rinse not being a requisite step in all operations. The parts thereafter proceed to an electrocleaning step where they are immersed and an electrical current is applied for the purpose of removing any particulate material through the scrubbing action of gases evolved at the surfaces of the metal components which ultimately forms the metallic substrate. The cleaned parts are then rinsed of residual alkaline cleaner and proceed to acid activation and the remaining plating cycle baths. Since the majority of all future operations and processing is performed through a programmable controlling network, each stage of the plating cycle must perform so as not to interfere or otherwise create problems in the processing operations or stages which follow. A lack of efficacy or performance in one individual stage could, it can be appreciated, result in the rejection of a significant number of parts and components.

The formulation of the present invention finds its utility in the initial cleaning stages. The commonly abundant oily soils and soil-retaining oils are frequently found on the parts following their production, and these must be processed and effectively cleaned before the parts move to a subsequent stage in the operation. Again, these soils must be removed and effectively isolated so that there is no carry-over of these oily soils into subsequent baths. Traditionally, a highly alkaline soaking cleaner has been utilized at excessively high temperatures, such as in the range of 180°–200° F., with such extreme conditions being required in order to insure complete cleaning and ultimate isolation of the oily soils. Since the oily soils will normally float to the surface, frequent skimming of the surface is necessarily performed in order to remove these oils so as to avoid, reduce, or eliminate carry-over. If not removed, the oils tend to re-deposit on the surfaces of the parts passing through the individual operation, and eventually cause contamination or cross-contamination of subsequent processing baths. Constant overflow skimming also is cost ineffective inasmuch as such operations cause excessively high consumption of chemicals due to dilution, and also increase the effluent load. The various pollution control agencies are, of course, necessarily monitoring the effluent conditions, and the discharge of substantial quantities of industrial waste becomes a cost-sensitive consideration. Treatment facilities may, in certain instances, levy surcharges upon industrial users due to the nature and quantity of the effluent discharged into the system. The formulation of the present invention reduces the impact of the effluent discharge, since only modest cooling will result in a substantial and significant separation of layers through stratification of the oily soils. These stratified layers may, of course, be effectively skimmed so as to effectively handle the problem.

The formulation of the present invention functions at nearambient temperatures, such as in the range of 100°–130° F., thereby substantially reducing the overall energy requirements. The composition effectively emulsifies oily soils which in the past had required frequent skimming and maintenance. The overall volume of effluent to be discharged into the treatment systems is effectively reduced.

The composition permits concentration, separation, and segregation of effluent when allowed to stand and cool to room temperature. The oily soils demulsify and may be collected without interferring with the normal work load of the day, and without placing any unusual energy requirement upon the operation. Soils can be collected between shifts rather than interfere with the regular processing operations.

Since the soils can be effectively separated, solution life is extended through the full utilization of the chemicals involved, thereby minimizing the environmental impact of frequent and heavy discharges.

I claim:

1. A formulation for the treatment of the surfaces of ferrous metal parts having the following formulation:

| Composition | Percent by Weight |
|---|---|
| (A) An alkaline builder including, in the composite, sodium hydroxide, sodium metasilicate, and sodium carbonate wherein the components are present as follows: | |
| Sodium hydroxide | 15–30 |
| Sodium metasilicate | 10–30 |
| Sodium carbonate | 10–30 |
| (B) A water conditioner including, in the composite, sodium tripolyphosphate and tetrasodium ethylenediaminetetraacetate in the concentrations: | |
| Sodium tripolyphosphate (determined as anhydrous) | 10–15 |
| Tetrasodium ethylene-diaminetetraacetate (determined as the tetrahydrate) | 1–5 |
| Alpha-sodium glucoheptonate (determined as the dihydrate) | 5–15 |
| (C) A surfactant, including, in the composite, the sodium salt of petroleum sulfonic acid (petroleum sulfonate) | 1–10 |
| Linear ethoxylated alcohol organic phosphate ester complex | 1–10 |
| $RO(CH_2CH_2O)_n$<br>$RO(CH_2CH_2O)_n$—P=O<br>$RO(CH_2CH_2O)_n$<br>Wherein R represents an alkyl group containing from between 8 and 10 carbon atoms and wherein "n" is an integer ranging from 1 to 6. And a modified straight chain aliphatic polyether having the structural formula as follows: $R—O(CH_2CH_2O)_nCH_2CH_2R^1$ R—alkyl $R^1$—a hydrophobic group | 1–10 |
| (D) Hexylene glycol | 1–10 |

2. The formulation as set forth in claim 1 being particularly characterized in that

| | Composition | Percent by Weight |
|---|---|---|
| (A) | An alkaline builder including, in the composite, sodium hydroxide, sodium metasilicate, and sodium carbonate wherein the components are present as follows: | |
| | Sodium hydroxide | 25.0 |
| | Sodium metasilicate | 10.0 |
| | Sodium carbonate | 30.0 |
| (B) | A water conditioner including, in the composite, sodium tripolyphosphate and tetrasodium ethylenediaminetetraacetate in the concentrations: | |
| | Sodium tripolyphosphate (determined as anhydrous) | 15.0 |
| | Tetrasodium ethylene-diaminetetraacetate (determined as the tetrahydrate) | 1.0 |
| | Alpha-sodium glucoheptonate (determined as the dihydrate) | 5.0 |
| (C) | A surfactant, including, in the composite, the sodium salt of petroleum sulfonic acid (petroleum sulfonate) | 5.0 |
| | Linear ethoxylated alcohol organic phosphate ester complex | 1.7 |
| | $RO(CH_2CH_2O)_n$<br>$RO(CH_2CH_2O)_n$—P=O<br>$RO(CH_2CH_2O)_n$<br>Wherein R represents an alkyl group containing from between 8 and 10 carbon atoms and wherein "n" is an integer ranging from 1 to 6. And a modified straight chain aliphatic polyether having the structural formula as follows: $R—O(CH_2CH_2O)_nCH_2CH_2R^1$ R—alkyl $R^1$—a hydrophobic group | 1.7 |
| (D) | Hexylene glycol | 5.6 |

3. The method of cleaning ferrous metal parts which includes the step of immersing said parts into an aqueous solution containing from between about 4 and 10 ounces per gallon of a formulation having the following composition:

| Composition | Percent by Weight |
|---|---|
| (A) An alkaline builder including, in the composite, sodium hydroxide, sodium metasilicate, and sodium carbonate wherein the components are present as follows: | |
| Sodium hydroxide | 15–30 |
| Sodium metasilicate | 10–30 |
| Sodium carbonate | 10–30 |
| (B) A water conditioner including, in the composite, sodium tripolyphosphate and tetrasodium ethylenediaminetetraacetate in the concentrations: | |
| Sodium tripolyphosphate (determined as anhydrous) | 10–15 |
| Tetrasodium ethylene-diaminetetraacetate (determined as the tetrahydrate) | 1–5 |
| Alpha-sodium glucoheptonate (determined as the dihydrate) | 5–15 |
| (C) A surfactant, including, in the composite, the sodium salt of petroleum sulfonic acid (petroleum sulfonate) | 1–10 |
| Linear ethoxylated alcohol organic phosphate ester complex | 1–10 |
| $RO(CH_2CH_2O)_n$<br>$RO(CH_2CH_2O)_n$—P=O<br>$RO(CH_2CH_2O)_n$<br>Wherein R represents an alkyl group containing from between 8 and 10 carbon atoms and wherein "n" is an integer ranging from 1 to 6. And a modified straight chain aliphatic polyether having the structural formula as follows: $R—O(CH_2CH_2O)_nCH_2CH_2R^1$ R—alkyl $R^1$—a hydrophobic group | 1–10 |
| (D) Hexylene glycol | 1–10 |

wherein said aqueous working solution is maintained at a temperature of between about 130° F. and 200° F.

* * * * *